United States Patent [19]

Trott

[11] 4,375,834

[45] Mar. 8, 1983

[54] CASING PERFORATION METHOD AND APPARATUS

[75] Inventor: Donald E. Trott, Victoria, Tex.

[73] Assignee: D & D Company Ltd., Victoria, Tex.

[21] Appl. No.: 276,945

[22] Filed: Jun. 24, 1981

Related U.S. Application Data

[63] Continuation of Ser. No. 39,348, May 16, 1979, abandoned.

[51] Int. Cl.[3] ..... E21B 43/116

[52] U.S. Cl. ..... 166/297; 175/4.51; 175/4.52; 166/55.1

[58] Field of Search ..... 175/4.51, 4.52, 4.55; 166/297, 55, 55.1, 212, 217

[56] References Cited

U.S. PATENT DOCUMENTS

| | | | |
|---|---|---|---|
| 1,875,583 | 9/1932 | Fox . | |
| 2,169,559 | 8/1939 | Halliburton | 175/4.52 X |
| 2,436,036 | 2/1948 | Defenbaugh . | |
| 2,906,339 | 9/1959 | Griffin . | |
| 2,965,031 | 12/1960 | Johns . | |
| 3,045,748 | 7/1962 | Schramm | 175/4.52 UX |
| 3,058,522 | 10/1962 | McElheny . | |
| 3,381,751 | 5/1968 | McLelland | 166/65 R |
| 3,441,095 | 4/1969 | Youmans | 175/59 |
| 3,706,344 | 12/1972 | Vann | 166/297 |
| 3,912,013 | 10/1975 | Vann | 166/297 |
| 3,957,115 | 5/1976 | Kerzee | 166/297 |
| 3,990,507 | 11/1976 | Vann | 166/55.1 |
| 4,078,611 | 3/1978 | Vann | 166/297 |
| 4,113,016 | 9/1978 | Trott | 186/55.1 |
| 4,158,389 | 6/1979 | Chammas et al. | 166/297 |

*Primary Examiner*—William F. Pate, III

*Attorney, Agent, or Firm*—Richards, Harris & Medlock

[57] ABSTRACT

Method and apparatus for perforating a well casing (14) with a large pressure differential toward the well casing (14) from the surrounding oil and gas-bearing strata using a casing gun attached on a wireline below the tubing is disclosed. A perforator (12) is attached to a casing gun adapter (10), the casing gun adapter (10) is releasably attached to production tubing (16) and inserted into the well casing (14). After the production tubing (16) is installed, a collar locator (26) and a firing mechanism (44) are run on a wireline and attached to the casing gun adapter (10). The casing gun adapter (10) and the perforator (12) are released from the tubing and lowered to a predetermined stratum using a collar locator where the perforator (12) is detonated. After detonation, the perforator (12) and casing gun adapter (10) are raised and secured in the production tubing (16). The collar locator (26) and the firing mechanism (44) are detached from the casing gun adapter (10). A hold-down means (510, 610 or 710) is attached to the perforator (12) or to the casing gun adapter (10). The hold-down means (510, 610 or 710) holds the perforator (12) in the well casing (14) during perforation and prevents movement of the perforator (12) after perforation. In an alternate embodiment, the hold-down (610) wedges the perforator (12) in the well casing during and after perforation.

30 Claims, 15 Drawing Figures

CASING PERFORATION METHOD AND APPARATUS

This is a continuation of application Ser. No. 039,348 filed May 16, 1979 abandoned.

TECHNICAL FIELD

This invention relates to oil and gas production, and more particularly, to the completion or re-completion of an oil and/or gas well for production.

BACKGROUND OF THE INVENTION

After completion of the drilling of an oil or gas well, the well casing, set during the drilling operation, must be perforated so that the oil and/or gas can enter the production tubing and be produced. Various methods are presently used for perforating the well casing. Generally, some type of jet or bullet gun device is lowered into the well casing, which, upon detonation, perforates the casing and permits the oil and/or gas to flow from the reservoir into the well.

To perforate a well casing, it is necessary to position the perforator device adjacent the oil and/or gas-bearing stratum. With the prior perforating method of using a high differential pressure in the well bore and a relatively large casing gun, the perforator is attached to the end of production tubing and inserted into the well casing. The length of the production tubing is adjusted to position the perforator device opposite the preselected stratum after a second radioactive correlation log is run inside the tubing. This is a time-consuming and expensive process because it often requires many short "subs" of pipe to adjust the production tubing so that the perforator will be positioned properly.

One prior method for perforating a well with a casing gun and differential pressure, as disclosed in U.S. Pat. No. 4,113,016, is to deposit the perforator in the well prior to running the production tubing. After insertion of the production tubing, a collar locator and connector tools are lowered into the well on a wireline and connected to the perforator. The collar locator is used to position the perforator adjacent the selected stratum. This prior method requires a special trip into the hole to deposit the perforator.

In high differential-to-the-well bore pressure perforation, a large pressure differential exists from the oil and/or gas-bearing stratum to the well casing. When using a perforator on a wireline cable in the perforation of a well, the inrushing flow of oil and/or gas attempts to force the perforating device up the well casing, with the result that the device can become jammed or fouled with the wireline cable in the well tubing or casing. An expensive and time-consuming fishing operation may then be required to remove the fouled cable and perforator. Thus, perforation under high pressure differential-to-the-well bore conditions using a perforator on a wireline has not been reliably performed with prior perforating devices.

High pressure differential-to-the-well bore perforating, using a casing gun, despite difficulties in operation, is highly desirable. A well perforated at a high pressure differential-to-the-well bore is more productive than one perforated at a low pressure differential and a well perforated with a casing gun is more productive than a well perforated with a smaller gun. Two reasons are presently advanced to explain the higher productivity. First, when the perforator detonates, each jet-cut hole is thoroughly cleansed, that is, the "carrot" (a piece of copper lining from the jet left in the hole) with the crushed and melted debris resulting from the detonation are cleared from each opening and all perforations are cleared out to produce. Second, the casing gun makes larger perforations and deeper holes. With a high pressure differential, debris is immediately driven from the perforated hole into the casing to be produced, and not into the oil and/or gas-bearing strata. This prevents contamination of the oil and/or gas-bearing stratum, thereby resulting in a more productive oil and/or gas well.

SUMMARY OF THE INVENTION

In accordance with the present invention, a method of perforating the casing of a well using a wireline with a high differential pressure to the well bore includes placing and holding in place a casing gun. The production tubing may or may not be in the well bore prior to the placement and holding in place of the casing gun.

In accordance with the present invention, apparatus for perforating the casing of a well includes a turret adapter with a large diameter body and a narrower neck. An axially disposed spring is attached to the neck and releasably secures the adapter to production tubing prior to insertion in the well. Splines attach a collar locator to a firing mechanism.

In accordance with the method of perforating a well by the apparatus disclosed, the collar locator is lowered into the well, and the splines releasably attach the firing mechanism to the neck of the turret adapter. An overshot secured to the bottom of the production tubing engages a radially disposed groove in the turret adapter to secure the casing gun adapter and perforator to the tubing string after perforating.

Further in accordance with the present invention, a method of perforating a well utilizes a casing gun having a diameter larger than the production tubing. The casing gun is run in from the bottom of the tubing string and releasably held thereto. The casing gun is then picked up on a wireline run through the production tubing and reattached to the bottom of the tubing string after perforation.

Further in accordance with the present invention a method of perforating a well includes forcibly holding down the perforator gun attached to a wireline with the pressure differential in the well bore. The perforator gun is releasably attached to the wireline.

In accordance with another embodiment of the invention, apparatus for releasably securing a perforator in a well casing includes a mandrel with longitudinally placed fins. A dog is attached to the mandrel at each of the fins. The dogs move from a retracted position to an extended position to wedge the perforator in the well casing to prevent upward movement. An outer cage attached to the mandrel slides (after perforating) upward over the dogs, that are engaging the well casing, to an up position, where the dogs are shielded from the well casing, thereby releasing the gun to move upward.

In accordance with still another embodiment of the invention, there is provided a hold-down means that includes a housing containing an electric motor. The electric motor is connected to triangular-shaped slips. The slips move to wedge the perforator in the well casing. The triangular-shaped slips have serrated edges which engage the well casing.

Still in accordance with the present invention, a method of perforating a well includes running into the well the casing gun perforator of a wireline below a collar locator. The casing gun is properly positioned for perforation and secured in this position by means of slips or dogs releasably wedged into the production casing. After the wireline is released from the gun and withdrawn, the production tubing is run and the wireline is again run to actuate the perforator safely under high differential pressure to the well bore conditions. After completing the perforation of the well, and when well conditions justify, the wireline is again released and withdrawn.

In accordance with a still further embodiment of the invention, the hold-down means includes a cylindrical weight attached by a cable to the perforator. The weight is shaped so as to fit into the production tubing inserted in the well casing.

BRIEF DESCRIPTION OF THE DRAWINGS

For a more complete understanding of the present invention and the advantages thereof, reference is now made to the following drawings in which.

DETAILED DESCRIPTION

Figure 1:
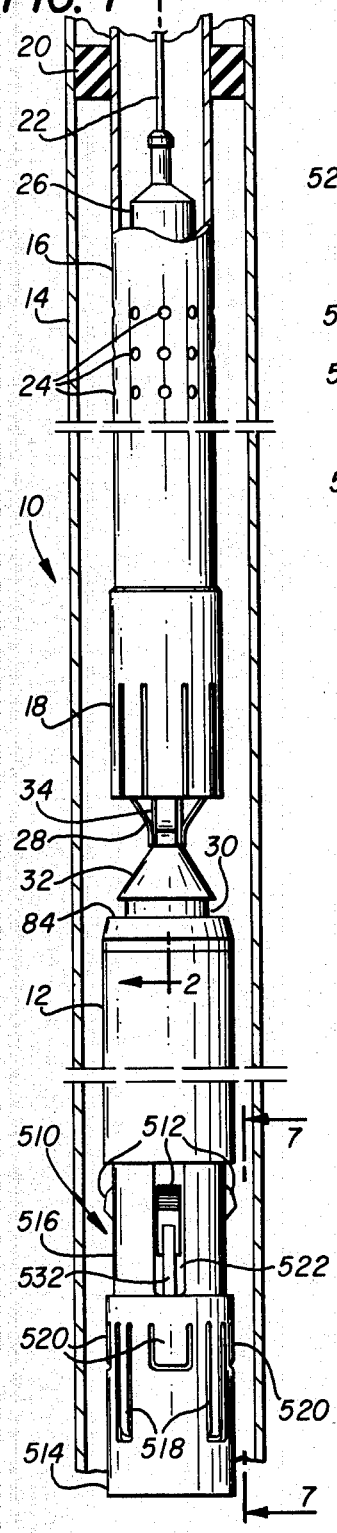
FIG. 1 is a sectional view of a perforator of the present invention in a well casing.
Figure 5:
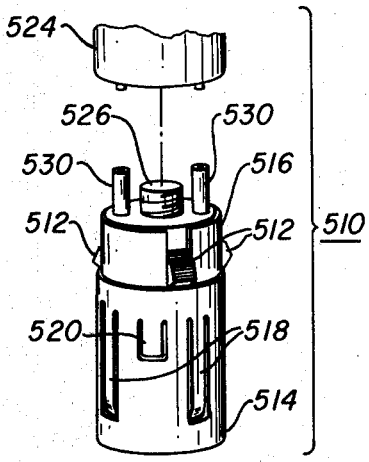
FIG. 5 is a partially exploded, perspective view of one embodiment of the hold-down device for the perforator of the present invention.
Figure 6:
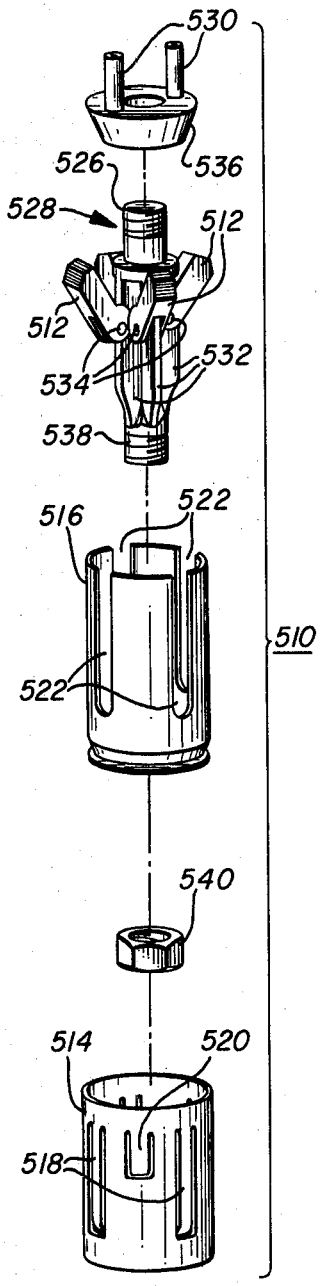
FIG. 6 is an exploded, perspective view of the hold-down device.

Referring now to the figures wherein like reference numerals designate like components, there is shown in FIG. 1 a casing gun adapter 10 attached to a perforator 12 hanging at the lower end of production tubing 16 and installed in a well casing 14. The production tubing 16 is run into the well after a splined overshot 18 and a perforator sub have been attached to the production tubing. A packer 20 is installed in the well around the production tubing 16 and inside the well casing 14. A hold-down 124 or 510 is attached to the bottom of the casing gun 12 for positioning thereof during the perforating sequence. A cable 22 leading from the surface is connected through a collar locator 26 and the releasable firing mechanism to the casing gun adapter 10.

The production tubing 16 is perforated with apertures 24 to permit the flow of oil and/or gas from the well casing 14 into the production tubing 16.

A plurality of springs 28 holds the casing gun adapter in the overshot 18. The springs 28 are attached to the neck 34 of the casing gun adapter 10. A groove 30, the need for which will be explained later, is located in a turret 32 at the neck 34 of the casing gun adapter 10. On the circumference of the turret 32 the groove 30 has a raised lip 84.

As seen in FIGS. 1 and 6–10, the hold-down 510 has an outer cage 514 slidably engaged over an inner cage 516. The surface of outer cage 514 is provided with splines 518 and 520. The inner cage 516 has slots 522 through which dogs 512, attached to hold-down 510, can project. The operation and construction of the hold-down 510 will be discussed hereinbelow.

Figure 2:
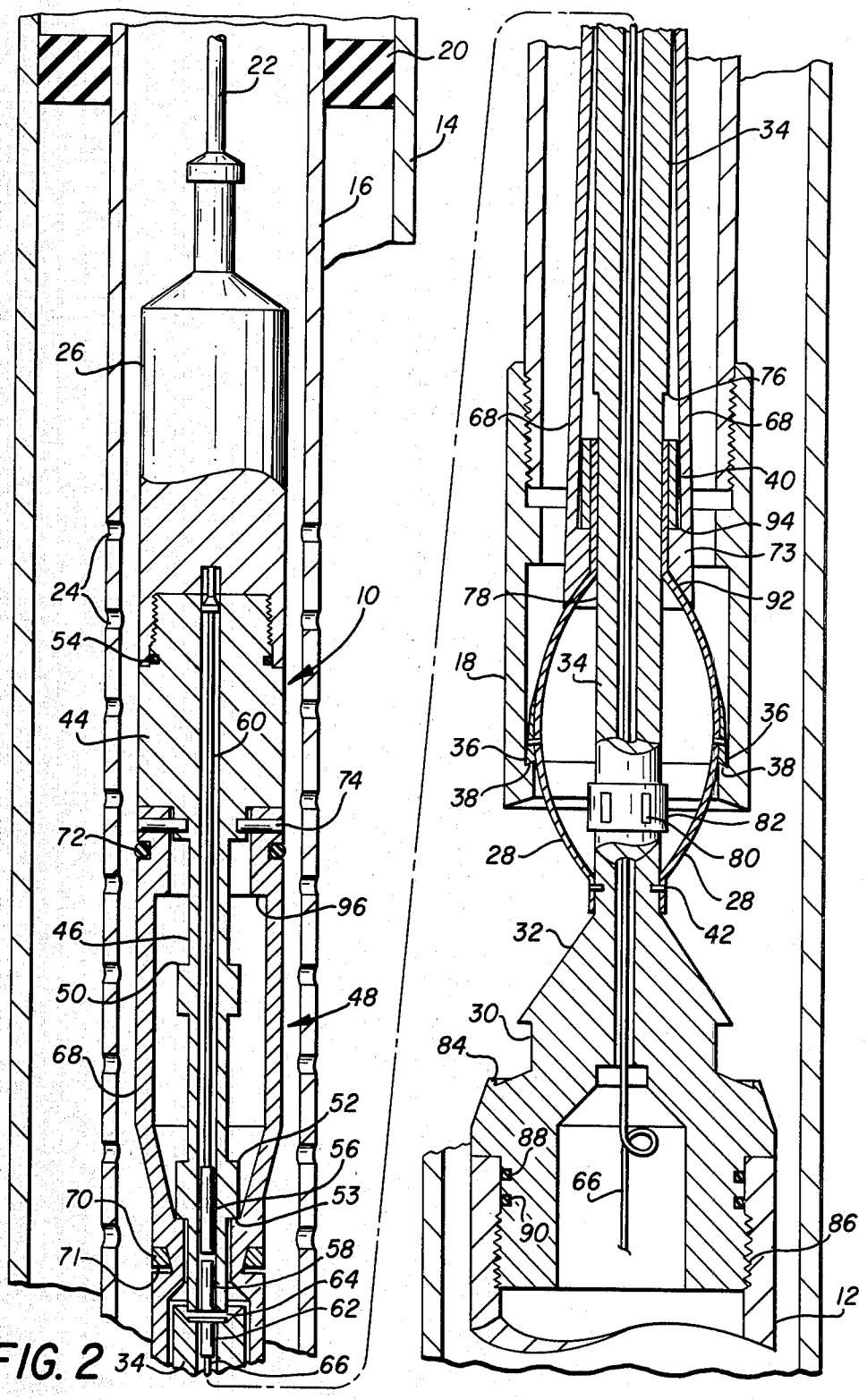
FIG. 2 is a cross sectional view taken along line 2—2 of FIG. 1 of the casing gun adapter of the present invention.

Referring to FIG. 2, the springs 28 are longitudinally disposed on the neck 34 of the casing gun adapter 10. The springs 28 releasably secure the casing gun adapter 10 in the overshot 18 by means of teeth 36 attached to the springs and engaging the recessed portion 38 of the overshot 18. A sliding ring 40, positioned on a narrowed portion of the neck 34, is secured to one end of the springs 28, while a suitable attaching means 42 secures the other end of the springs 28 to the neck. The springs 28 are biased outwardly to keep the teeth 36 securely engaging the recess 38.

A shoulder 76 on the neck 34 marks a constricted portion along which the ring 40 slides. The sliding ring 40 is dimensioned so that it will not slide up the neck 34 beyond the shoulder 76.

The springs 28 are equipped with centralizers 78 which keep the springs equally spaced around the circumference of the neck 34. The ends of the springs 28 farthest the turret 32 are secured to a sliding ring 40 which slides on the neck 34. At the ends of the springs 28 nearest the turret 32, a centralizer 80 is attached to a sliding ring 82 fitting about the neck 34, with the ends of the centralizer springs attached to the neck 34.

The neck 34 flares in diameter below the springs 28 to form the turret 32 that includes threads 86 engaging the perforator 12. Seals 88 and 90 fit in recesses in the turret 32 and form a seal between the turret 32 and the perforator 12.

A firing mechanism 44 threads into the collar locator 26 with a seal 54 located in a groove of the firing mechanism and engaging the inner surface of the collar locator. The firing mechanism 44 has an outside diameter approximately the same as the outside diameter of the collar locator 26, and further includes a necked down narrower section 46. The firing mechanism 44 also includes raised shoulder sections 50 and 52 axially displaced on the section 46. A longitudinal bore in the firing mechanism 44 holds a cap 56 and a bullet 58 to be fired during the well perforating process. A wire 60 is threaded through the bore and connects the cap 56 to a suitable source of electrical energy for detonation at the surface.

A releasing tool 48 is attached to the firing mechanism 44 and includes multiple splines 68 which fasten about the sliding ring 40 around the neck 34 and is attached to the neck 34 by springs 28. The splines 68 are attached to the firing mechanism 44 by shear pins 74. The shear pins 74 are sized to shear at a differential pull of 1,000 pounds, though other size shear pins can be used in the proper circumstances, as will be suggested to those of skill in the art.

A steel ring 70 is placed in a groove 71 formed in the splines 68 and a rubber or coiled circular spring 72 is located in a similar groove in the splines adjacent the shear pins 74. As will be described hereinbelow, the rubber or coiled circular spring 72 causes the splines 68 to pivot about the shoulder 52.

At the end of the splines 68 that engage the sliding ring 40 and opposite the shear pins 74 are lips 73. The lips 73 engage the sliding ring 40 and hold the releasing tool 48 to the neck 34. The releasing tool 48 maintains the cap 56 and the bullet 58 in close proximity to the upper end of the neck 34.

As is to be seen in FIG. 2, there is a small gap 64 between the firing mechanism 44 and the neck 34. Those skilled in the art will appreciate that firing mechanism 44 may directly abut the neck 34.

Located in a bore of the neck 34 is a booster 62. A primer cord or fuse 66 running through the bore connects the booster 62 to the perforator 12.

Figure 4:
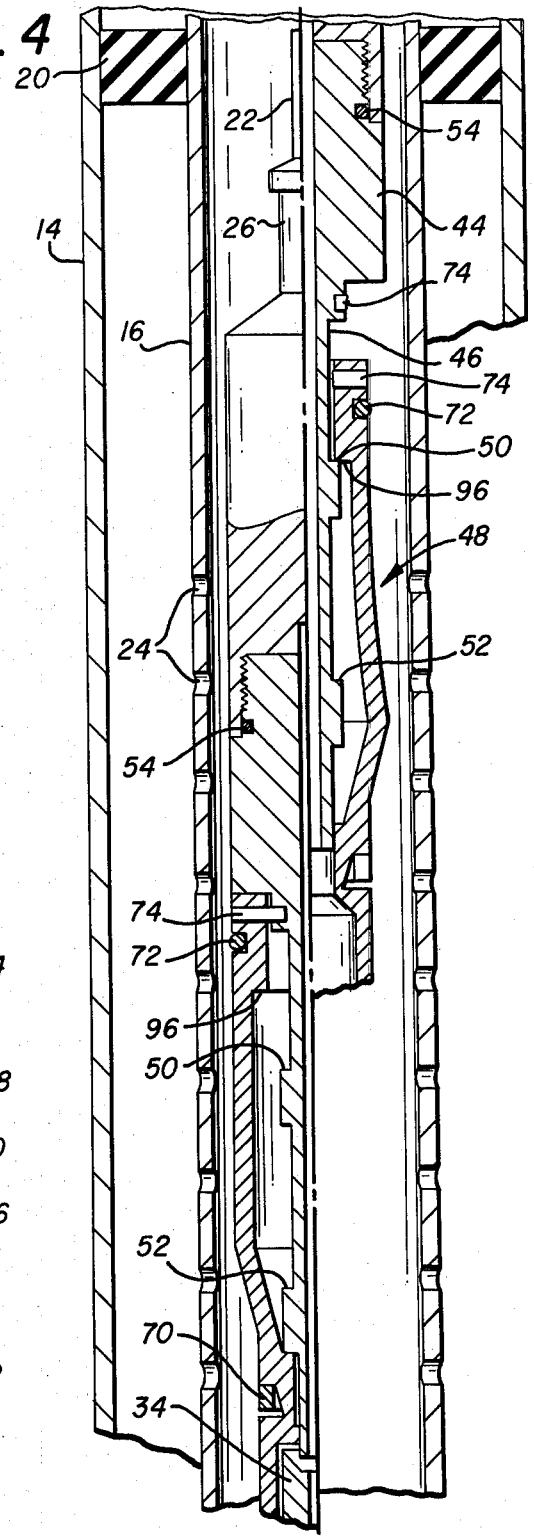
FIG. 4 is a cross sectional detailed view of the casing gun adapter wherein the left half of the figure shows the adapter in one mode, and the right half of the figure depicts it in a second mode.
Figure 3:
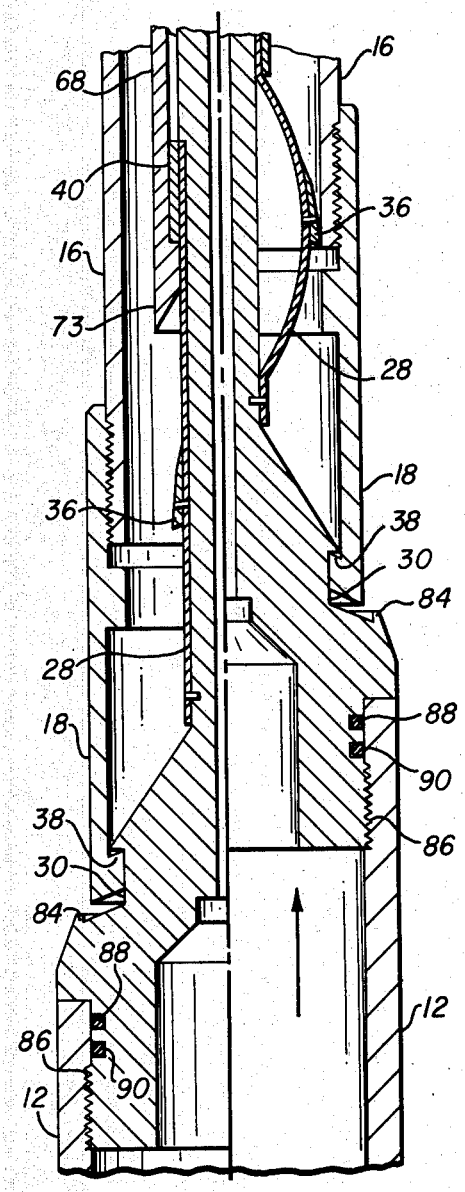
FIG. 3 is a cross sectional view of the casing gun adapter, with the left half of the figure depicting one mode, and the right half of the figure depicting a second mode.

Referring to FIGS. 2–4, the process of perforating an oil and/or gas-bearing stratum with the present invention is to be described. The overshot 18 is attached to the production tubing 16 before the tubing is lowered into the well. The perforator 12 is attached to the turret 32, the springs 28 are collapsed, and the neck 34 is inserted into the overshot 18 and into engagement with the production tubing 16. When the springs 28 are released, the teeth 36 engage the recessed portion 38 of the overshot 18.

The production tubing 16 with the attached casing gun adapter 10 and perforator 12 is lowered into the well casing 14. A sufficient length of production tubing 16 is run into the casing 14 to position the perforator 12 above the selected stratum to be perforated.

The collar locator 26 is attached to the cable 22, and to the releasing tool 48 which is attached to the firing mechanism 44. When the well is ready to be perforated, the collar locator 26, firing mechanism 44 and releasing tool 48 are then lowered on cable 22 through the production tubing 16 until the splines 68 engage the neck 34. The splines 68 are lowered along the neck 34 until the beveled edge 92 of the splines passes over the sliding ring 40; the shoulder 94 then engages the lower edge of the sliding ring 40.

To position the perforator 12 opposite the selected oil and/or gas-bearing stratum, the cable 22 is first raised. As the cable 22 is raised, the shoulder 94 of the splines 68 engages the sliding ring 40 and moves the ring toward the shoulder 76. Movement of the sliding ring 40 causes the springs 28 to be compressed toward the neck 34. The teeth 36 are no longer in engagement with the recessed portion 38 of the overshot 18, and the casing gun adapter 10 is no longer held in the overshot 18. Casing gun adapter 10 and attached apparatus may now be positioned by lowering the cable 22 and locating the casing collar using the collar locator in a conventional manner until the perforator is at the anticipated oil and/or gas-bearing stratum. An adjustment of the cable 22 positions the perforator 12 opposite the selected stratum.

Electrical energy from a source at the well head is applied to detonate the cap 56 by means of the wire 60. Detonation of the cap 56 fires the bullet 58 that in turn ignites the booster 62, the fuse 66, and the perforator 12. On perforation, any one of the hold-down devices described herein will be used to prevent the gun and other apparatus in the well from being blown up the hole.

After perforating the well casing 14 opposite the preselected stratum, the casing gun adapter 10 is drawn into the overshot 18, see FIG. 3, by raising the cable 22. The casing gun adapter 10 is designed so that the groove 30 in the turret 32 engages the recessed portion 38 of the overshot 18, as seen in FIG. 3. By withdrawing the casing gun adapter into the overshot 18, the perforator 12 is secured to the production tubing 16.

In the preferred embodiment, approximately 500 pounds is required to pull the casing gun adapter 10 into the overshot 18. This prevents the gun from being pulled into the overshot 18 unintentionally when the gun is first picked up. Varying the stiffness of the splines in the overshot 18 and different sizes of the groove 30 will be suggested to those of skill in the art, as the circumstances require.

After the casing gun adapter 10 is secured in the overshot 18, upward tension on cable 22 shears the pins 74. Shearing of the pins 74 releases the firing mechanism 44 and the collar locator 26 from the casing gun adapter 10. In the left half of FIG. 3, the casing gun adapter 10 is secured in the production tubing 16 after completing the perforation of the well. In the right half of FIG. 4, upward tension has been applied to the cable 22 so that the shear pins 74 have sheared, releasing the releasing tool 48, the firing mechanism 44, and the collar locator 26 from the neck 34.

As the upper end of the splines 68 rotate inwardly by pivoting about the shoulder 53 as a result of shearing the pins 74, the lower end of the splines 68 lever outwardly, releasing the lips 73 from the sliding ring 40. The firing mechanism 44 moves up and away from the perforator 12 along with the releasing tool 48 and the locator 26. The upper inside shoulder 96 of the splines 68 engages the shoulder 50 of the firing mechanism 44, thereby allowing the releasing tool 48 to be pulled from the well with the collar locator 26 (not shown in the right side of FIG. 4).

The perforator 12 remains in the overshot 18 until the production tubing 16 is pulled; the perforator 12 may then be removed. The right half of FIG. 3 depicts the pulling of the production tubing 16, the casing gun adapter 10, and the perforator 12 from the well.

Referring to FIGS. 5–10, there is shown the hold-down 510 having a top cylinder 524 with two small cylinders for receiving pistons 530 extending from a tapered ring 536, bored through the top cylinder. The top cylinder 524 is of a heavy-walled construction to shield the hold-down 510 from the detonation forces resulting from the operation of the perforator 12.

Figure 10:
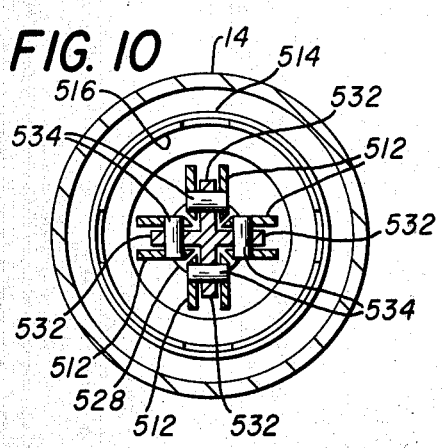
FIG. 10 is a cross sectional view of the hold-down device taken along line 10—10 in FIG. 7.

The component parts of hold-down 510 include a mandrel 528 having longitudinally disposed fins 532. Attached to each fin 532 is a dog 512 by means of a pin 534, as best shown in FIG. 10. A left-handed thread 526 is cut into the mandrel 528 for attaching the mandrel to the top cylinder 524. The mandrel 528 slidably passes through the ring 536 to the left-handed thread 526. At the other end of mandrel 528 are threads 538 which pass through an aperture (not shown) in the base of the inner cage 516. A nut 540 secures the inner cage 516 to the mandrel 528.

When assembled, the splines 520 hold the outer cage 514 onto the inner cage 516 in the down position and the splines 518 hold the outer cage onto the inner cage in the up position.

Figure 7:
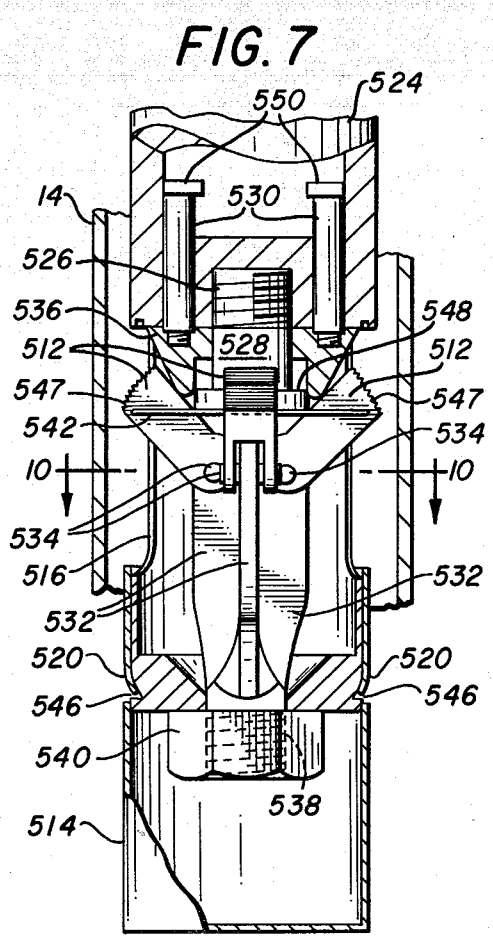
FIG. 7 is a cross sectional view of the hold-down device taken along line 7—7 in FIG. 1.

Referring to FIG. 7, the hold-down 510 of the present invention is shown in the running or moving position. The outside cage 514 is in a down position and the dogs 512 are held in place against the ring 536 by means of a wire 542. The splines 520 of the outer cage 514 engage a groove 546 of the inner cage 516 to hold the outer cage to the inner cage while the hold-down 510 is being lowered into the well casing 14. The ring 536 is in the up position at this time so that the dogs 512 cannot engage the well casing 14.

The wire 542 passing through holes 544 in the dogs 512 prevents the dogs from engaging the well casing 14 while the hold-down 510 is being lowered into the well. The wire 542 is used only to prevent the dogs 512 from accidently engaging the well casing 14.

Figure 8:
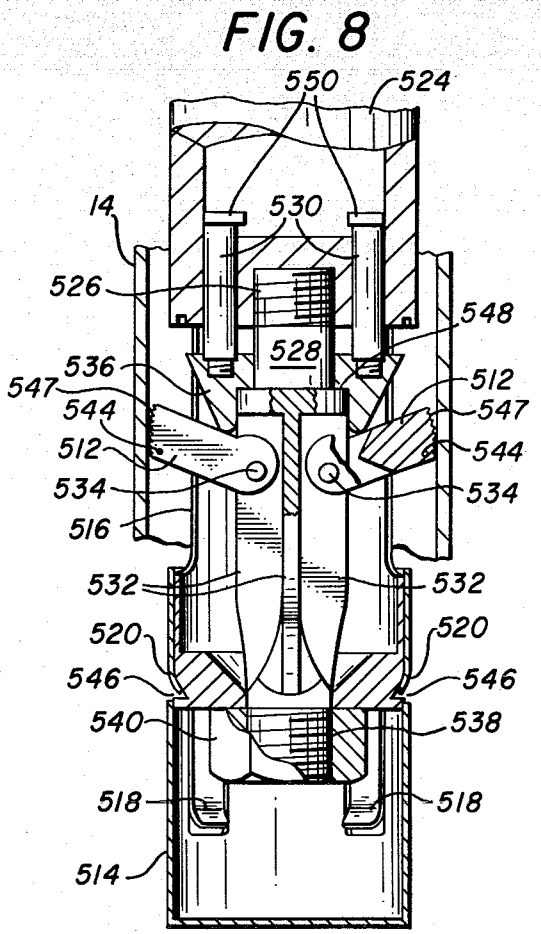
FIG. 8 is a cross sectional view of the hold-down device as seen in its operating position.

Referring to FIG. 8, the hold-down 510 is seen in the set and locked position. The wire 542 has been broken, and the dogs 512 engage the well casing 14. The outer cage 514 is in the down position and the splines 520 engage the groove 546 of the inner cage 516.

Pressure developed in the well upon detonation of the perforator 12 forces the two small pistons 530 downward, moving the ring 536 to engage the dogs 512. As the dogs 512 pivot on their pins 534, the wire 542 breaks. The four dogs 512 produce a wedging action as their combined radius arms increase beyond the inside diameter of the well casing 14.

Movement of the ring 536 is stopped by engagement with a shoulder 548 of the mandrel 528. The shoulder 548 and the corresponding depth of the ring 536 limit the amount by which the dogs 512 can be moved to engage the well casing 14.

The ends 547 of the dogs 512 are shaped with two different angles so that the hold-down 510 can be used in different diameter pipe and are serrated to facilitate engagement with the well casing 14. Persons skilled in the art will readily appreciate that the hold-down 510 can be built for different sizes and weights of well casing.

Figure 9:
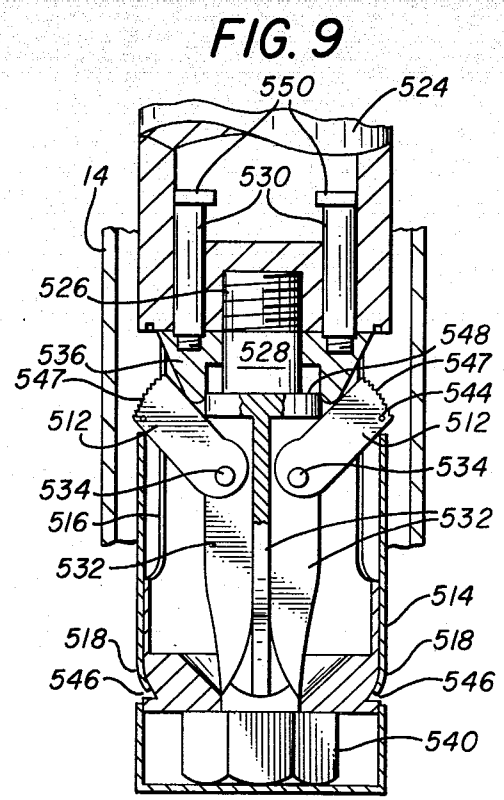
FIG. 9 is a cross sectional view of the hold-down device in its retracted position.

Referring to FIG. 9, to release the perforator 12 from the well casing 14, the production tubing 16 is lowered until the hold-down 510 rests on the bottom of the well. Downward force on the hold-down 510 forces the outer cage 514 upward. The outer cage 514 slides over the inner cage 516 and the dogs 512 pivot on their pin 534, thereby disengaging the dogs from the well casing 14. The splines 518, with an inward spring bias, lock the outer cage 514 over the inner cage 516. The splines 518 engage the groove 546 in the inner cage 516. In the up position, the dogs will not engage the well casing 14 as the perforator 12 is removed from the well.

The left-hand thread 526 in the mandrel 528 is a safety feature built into the hold-down 510. The dogs 512 may fail to retract from the casing engaging position, thereby preventing the removal of the perforator 12 from the casing 14. When this situation exists the production tubing 16 and the attached overshot 18 are lowered, after shearing the pins 74, and withdrawing the locator firing mechanism and the releasing tool until the overshot 18 engages the groove 30 of the casing gun adapter 10. The production tubing is then rotated and the cylinder 524 and the ring 536 are unscrewed from the top of the mandrel 528 by rotating the cylinder 524 to the right. The shoulders 550 on the pistons 530 engage the cylinder 524 and pull the ring 536 out with the upper part of the hold-down 510. A cylindrical milling tool (not shown) is then inserted in the well to mill the dogs 512.

Figure 11:
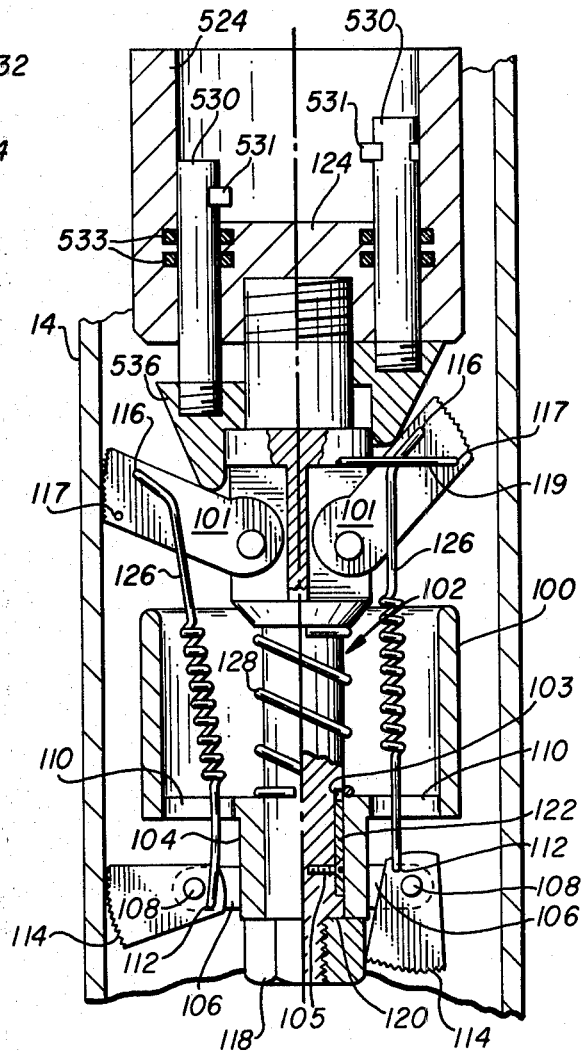
FIG. 11 is a cross sectional view of a second embodiment of a hold-down device, with the left half of the figure depicting one mode, and the right half of the figure depicting a second mode.
Figure 12:
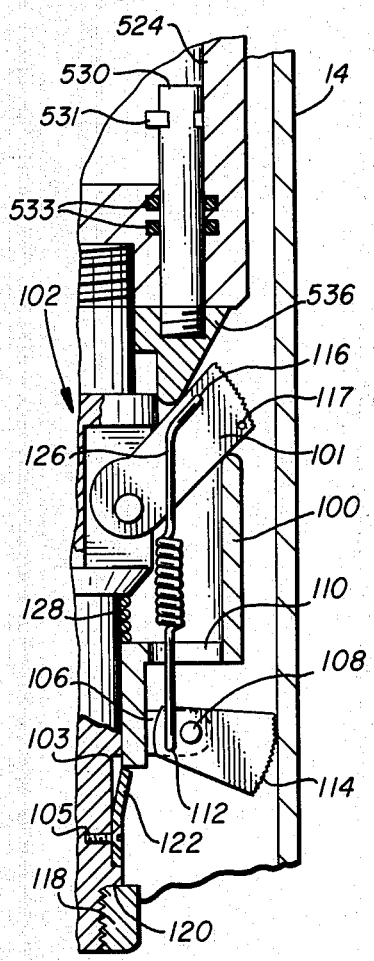
FIG. 12 is a cross sectional view of one half of the hold-down device of FIG. 11 shown in a return position.

Referring to FIGS. 11 and 12, there is shown another embodiment of a hold-down device which includes parts similar to the hold-down device 510 of FIGS. 5–10. That is, the hold-down device of FIGS. 11 and 12 includes the top cylinder 524 that receives the pistons 530 extending from a tapered ring 536. Threadedly engaged with the cylinder 534 is the threaded section of a mandrel 102 that includes fins (fore-shortened fins 532) with a dog 101 attached to each fin. The lower section of the mandrel 102 is a smooth cylinder that includes a locating notch 103. A cage 100 is slidably engaged over the smooth cylinder of the mandrel 102 and is held in place on the mandrel by means of a nut 118 threaded onto the mandrel against a shoulder 120. A spring 128 biases the cage 100 into the position shown in FIG. 11. Extending from the cage 100 are fins 106 that are in line with the fins for supporting the dogs 101. Attached to each of the fins 106 is a lower dog 114 by means of a pivot shaft 108.

Bored into each of the dogs 101 is a hole 116 and bored into each of the lower dogs 114 is a hole 112. Assembled into the holes of each of the dogs is an interconnecting spring 126 that causes the lower dog 114 to rotate with the corresponding dog 101.

To prevent the mandrel 102 from rotating, a key 104 is fitted into the notch 103 and held in place by means of a fastener 105. To allow the springs 126 to interconnect the dog 101 with a lower dog 114, openings 110 are cut into the disc-shaped portion of the cage 100.

In operation of the hold-down of FIGS. 11 and 12, a wire 119 passing through holes 117 of the dogs 101 holds the dogs 101 and the lower dogs 114 in the position illustrated in the right-hand side of FIG. 11. The hold-down device remains in this configuration until the casing gun is fired during a perforation operation. When the casing gun fires, the pistons 530 are driven downward until they reach the limit of the travel as established by shoulders 527. Liquids are prevented from flowing past the pistons 530 by means of O-rings 533. Driving the pistons 530 downward forces the ring 536 against the dogs 101 causing the downward rotation of these dogs until they contact the inner surface of the well casing 14. During this operation, the wire 119 is broken as it is no longer required in the completion of a well. Also, by means of the interconnecting spring 126 the lower dog 114 is caused to rotate outward in contact with the well casing 14. By use of the spring 126 the lower dog 114 rotates more slowly and will contact the well casing later than the dogs 101.

The left-hand side of FIG. 11 shows the hold-down device in its operating position after firing the casing gun. With the hold-down device in the position as illustrated on the left-hand side of FIG. 11, the well is cleaned up and shut-in in a conventional manner. With the hold-down device in this configuration, the dogs 101 prevent upward movement of the casing gun and the cage dogs 114 prevent downward movement of the cage 100. Note, however, that the cage 100 will slide on the mandrel 102.

When the operator is ready to release the casing gun and other equipment in the well, the wireline with the casing gun and related equipment attached is lowered down the well bore which allows the mandrel 102 to move downward relative to the cage 100. A downward movement of the mandrel 102 releases the dogs 101 from engagement with the well casing 14. Continued downward movement of the mandrel 102 causes the cage 100 to contact the dogs 101 as illustrated in FIG. 12. This forces the dogs 101 into their original pre-firing position and disengages from the well casing 14. As the cage 100 reaches its maximum travel with relation to the mandrel 102, a spring latch 122 is released from the notch 103 and contacts the lower surface of the cage 100. This securely latches the cage 100 and the dogs 101 into the position shown in FIG. 12. The springs 126 allow for relative movement between the dogs 100 and the lower dogs 114.

To remove the casing gun, with its associated apparatus, and the hold-down from the well bore, the wireline is pulled upward which will rotate the lower dogs 114 into the position illustrated in the right-hand side of FIG. 11. At this time, both the upper dogs 101 and the lower dogs 114 are no longer in engagement with the well casing 14 allowing the free movement of the hold-down device and attached equipment in the well bore.

Figure 13:
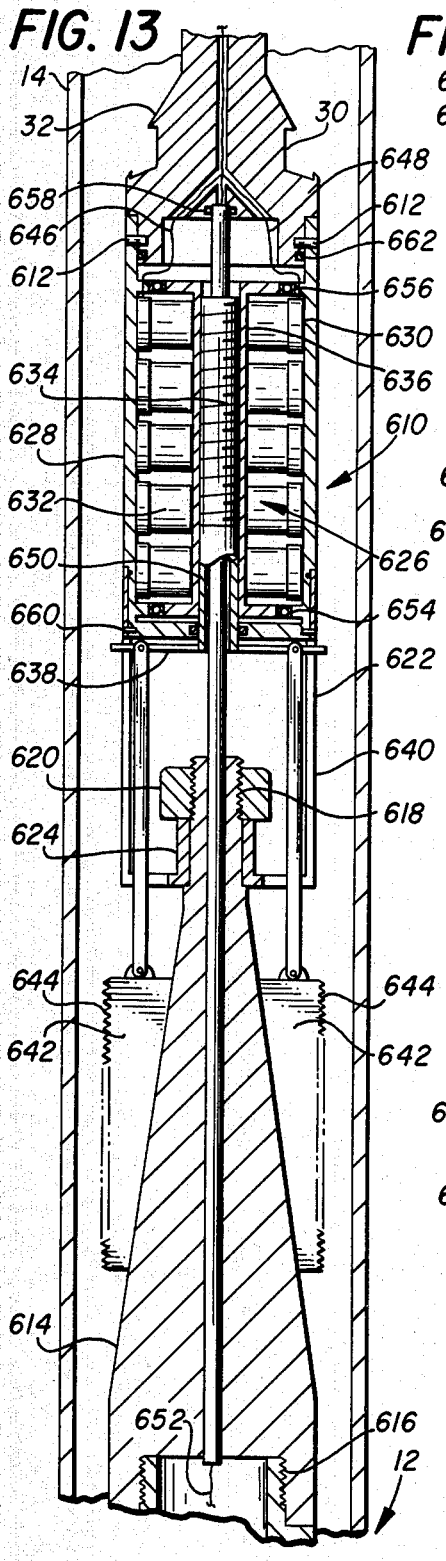
FIG. 13 is a cross sectional view of a third embodiment of the hold-down device of the present invention in a retracted position.
Figure 14:
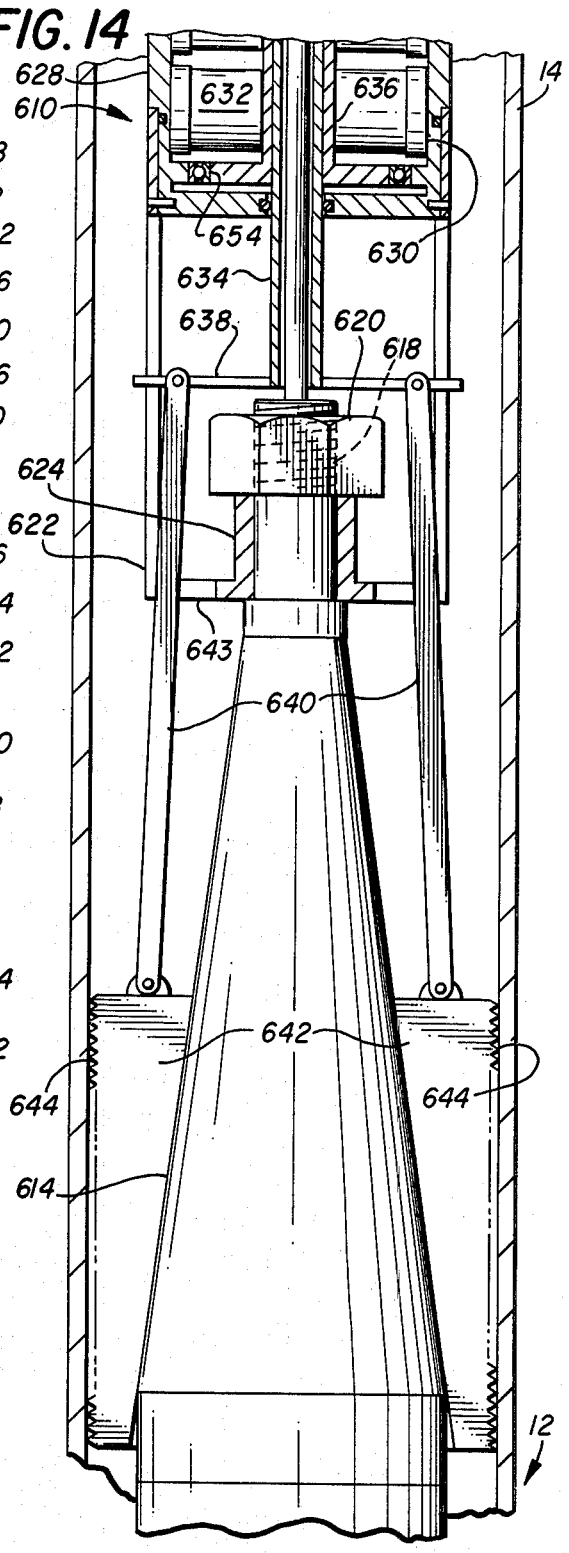
FIG. 14 is a cross sectional, detailed view of the hold-down device of FIG. 13 in the operating position.

Referring to FIGS. 13 and 14, there is shown a second embodiment of the hold-down device of the present invention. Hold-down 610 is attached to the turret 32 at the top by means of bolts 612, and at the bottom to the perforator 12. The attachment to the perforator 12 is through a cone-shaped adapter 614 having internal threads 616 engaging external threads of the perforator 12. At the top portion of the adapter 614 there is a threaded section 618 and a nut 620 which secures the cone-shaped adapter to the hold-down 610 that includes a housing 622 having a cylindrically-shaped shoulder 624 that fits onto the cone-shaped adapter 614.

To provide operating power for the hold-down 610 an electric motor 626 is located in a motor housing 628. The electric motor 626 moves the slips 642, as will be described. The electric motor 626 includes a field coil 630 and an armature 632 that includes a core 636. The field coil 630 is connected by means of wires 646 and 648, that pass through a bore in the turret 32, to a source of power (not shown) located at the well surface.

Rotatably mounted in the motor housing 628 is the internally threaded core 636 engaging a mandrel 634. The core 636 turns on the bearings 654 and 656, press fit into the motor housing 628. To protect the electric motor 626 from contaminating materials, such as water and mud, located in the well casing 14, there is provided seals 658, 660 and 662. A drive rod 638 is attached to the end of the mandrel 634 and is connected to connecting rods 640. Each connecting rod 640 connects by a pivot means to a slip 642.

The slips 642 have a generally triangular shape, and are located around the outer surface of the cone-shaped adapter 614. The triangular shape of the slips 642 is complementary to the shape of the cone-shaped adapter 614, so the slips slide along the cone-shaped adapter, as will be described. Each slip 642 has a serrated edge 644 that is designed to engage the well casing 14, as seen in FIG. 13.

A fuse 652 for activating the perforator 12 runs through a tube 650 in the mandrel 634. The fuse 652 ignites the perforator 12.

In operation, a voltage is applied through the wires 646 and 648 to energize the electric motor 626. The armature 632 of the electric motor 626 turns on the bearings 654 and 656. Since the mandrel 634 is held from rotating, rotation of the armature 632 causes the mandrel to translate with respect to the housing 628. The movement of the mandrel 634 moves the slips 642 into a wedging position between the cone-shaped adapter 614 and the well casing 14, as seen in FIG. 14.

Figure 15:
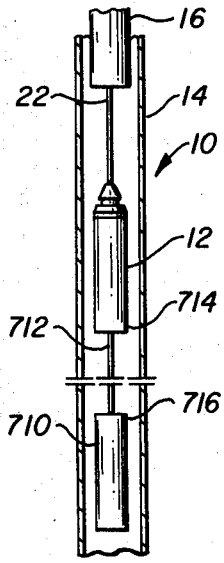
FIG. 15 shows another embodiment of the hold-down device of the present invention.

Referring to FIG. 15, there is shown a third embodiment of the hold-down of the present invention and includes a cylindrical weight 710 attached to the perforator 12 by means of a cable 712. A suitable connecting means 714 attaches the cable 712 to the perforator 12. Another connecting means 716 attaches the cable 712 to the cylindrical weight 710.

The cylindrical weight 710 has appropriate diameter and length so as to fit in the casing 14 while providing sufficient inertia to prevent the violent upward movement of the casing gun adapter 10 and the perforator 12 when carrying out the perforation of the well casing 14.

In operation, perforator 12 is lowered to the selected oil and/or gas-bearing stratum as hereinbefore described. Upon detonation of the perforator 12, oil and/or gas rushes into the well casing 14. The inertia provided by the cylindrical weight 710 counteracts the upward force of the inrushing oil and/or gas, thereby preventing the perforator 12 and the casing gun adapter 10 from tangling the cable 22 in the well casing 14.

Although several embodiments of the invention have been illustrated in the accompanying drawings and described in the foregoing Detailed Description, it will be understood that the invention is not limited to the embodiments disclosed, but is capable of numerous rearrangements, modifications, and substitutions without departing from the scope of the invention.

I claim:

1. A differential pressure casing gun adapter for attachment to production tubing by means of an overshot comprising:

a turret adapter with a base and a neck, said base being of greater diameter than said neck;

a plurality of axially disposed springs fixed to said neck, said springs releasably engaging the overshot;

a firing mechanism;

a plurality of splines having one end attached to said firing mechanism and disposed generally parallel to said neck and in sliding engagement with said neck, the second end of said splines in contact with said springs, said splines securing said firing mechanism proximately to said neck;

a collar location means; and connection means for releasably securing said collar location means to said firing mechanism.

2. The differential pressure casing gun adapter in claim 1 wherein said turret adapter has a radially disposed groove for receiving the overshot.

3. The differential pressure casing gun adapter in claim 1 wherein said connection means for securing said collar location means to said firing mechanism includes at least two shear pins.

4. The differential pressure casing gun adapter in claim 1 wherein said turret adapter has an axially disposed bore in said neck, said bore containing a blasting cap, means for actuating said blasting cap, and a primer cord.

5. A hold-down attached to perforator means comprising:

a mandrel with a plurality of fins;

a plurality of dogs attached to said mandrel, one dog attached to each of said fins, said dogs moving from a retracted position to an extended position wherein said dogs wedge against the inside diameter of a well casing;

a collar fitting about said mandrel;

a piston attached to said collar and pushing said collar against said dogs, thereby pivoting said dogs from the retracted position to the extended position;

an inner cage secured to said mandrel;

an outer cage slidably attached to said inner cage and moving from a first position wherein said dogs freely pivot to a second position wherein said outer cage disengages and shields said dogs from the well casing; and a plurality of splines defined in said outer cage, said splines securing said outer cage to said inner cage when said outer cage is in the second position.

6. The hold-down in claim 5 wherein said fins on said mandrel are equally radially spaced about said mandrel.

7. The hold-down in claim 5 wherein said mandrel includes a shoulder for engaging said collar after a predetermined amount of motion of the collar with respect to the mandrel to limit the movement of said dogs.

8. A method of perforating the casing of a well at a predetermined stratum with a perforator means, comprising the steps of:

running tubing with the perforator means releasably attached thereto into the well, the perforting means including a perforator larger in diameter than the inner diameter of the tubing;

running an electrical cable extending from the well head into the well within the tubing for attachment to the perforator means;

releasing the perforator means from the tubing after attachment to the electrical cable;

positioning the perforator means opposite the predetermined stratum by means of said cable;

detonating the perforator means by a source of electrical energy at the well head; and reattaching the perforator means to the tubing by means of said cable.

9. The method of claim 8 including the steps of:

connecting the electrical cable to the perforator means; and applying a force to the electrical cable to release the perforator means from the tubing.

10. The method of claim 9 wherein the step of positioning the perforator means includes running the perforator means in said well when connected to the electrical cable.

11. The method of claim 9 including the step of releasing the electrical cable from the perforating means following the step of reattaching the perforator means to the tubing.

12. A method for perforating the casing of a well at a predetermined stratum with a perforator means, comprising the steps of:

running production tubing with a casing gun adapter, perforator means, and hold-down means releasably attached thereto into the well;

positioning the casing gun adapter, the perforator means, and the hold-down means opposite the stratum by means of a wireline;

detonating the perforator means;

wedging the hold-down means in the casing of the well by detonation of the perforator means;

releasing the hold-down means from the casing;

lifting the casing gun adapter, the perforator means, and the hold-down means to the production tubing; and reattaching the casing gun adapter, perforator means and hold-down means to the production tubing.

13. A method for perforating the casing of a well at a predetermined stratum with a perforator means, comprising the steps of:

running production tubing with a casing gun adapter, the perforator means, and hold-down means releasably attached thereto into the well;

running an electrical cable into the well within the production tubing for attachment to the casing gun adapter;

releasing the casing gun adapter, the perforator means, and the hold-down means from the production tubing;

positioning the casing gun adapter, the perforator means and the hold-down means opposite the stratum by means of the electrical cable;

detonating the perforator means to perforate the casing of the well and wedge the hold-down means in the well casing;

releasing the hold-down means from the casing of the well; and reattaching the casing gun adapter, perforator means, and hold-down means to the production tubing.

14. The method of claim 13 wherein the step of releasing the casing gun adapter, perforator means and the hold-down means includes applying a force to the electrical cable to release the casing gun adapter, perforator means and hold-down means from the production tubing.

15. The method of claim 13 including the step of releasing the electrical cable from the casing gun adapter after reattachment to the production tubing.

16. The method for perforating the casing of a well at a predetermined stratum with a perforator means, comprising the steps of:

running production tubing with a casing gun adapter, the perforator means, and a hold-down means releasably attached thereto into the well;

running an electrical cable with a firing mechanism attached thereto into the well within the production tubing for attachment to the casing gun adapter;

releasing the casing gun adapter from the production tubing when attached to the firing mechanism;

positioning the perforator means at the predetermined stratum by means of the electrical cable;

detonating the perforator means by the firing mechanism connected to the electrical cable; and reattaching the casing gun adapter to the production tubing by means of the electrical cable.

17. A method for perforating the casing of a well at a predetermined stratum by means of a perforator means, comprising the steps of:

running production tubing with a casing gun adapter, the perforator means, and a hold-down means releasably attached thereto into the well;

running a firing mechanism into the well;

releasably attaching the firing mechanism to the casing gun adapter;

positioning the perforator means to the predetermined stratum;

detonating the perforator means;

wedging the hold-down means in the casing of the well by detonation of the perforating means;

disengaging the hold-down means from the casing of the well; and reattaching the casing gun adapter to the production tubing.

18. The method of claim 17 and further comprising the steps of:

uncoupling said firing mechanism from said casing gun; and removing said firing mechanism from the well.

19. Apparatus for use with a cable for positioning a perforator means in a well casing comprising:

a cylindrical turret with a flared end, the flared end suitable for attachment to the perforator means;

elastic members axially disposed on said turret;

locating means attached to the cable; and a plurality of axially disposed splines attached to said locating means for releasably attaching said locating means to said turret.

20. The apparatus in claim 19 and further comprising:

a firing mechanism attached to said locating means; and sharing means securing said splines to said firing mechanism.

21. The apparatus in claim 20 wherein said shearing means comprises shear pins.

22. Apparatus for holding a perforator means in a well casing comprising:

a mandrel with a plurality of axially disposed mandrel fins and a cylindrical section extending from the fins;

a first plurality of dogs pivotally attached individually to one of the mandrel fins, said first plurality of dogs pivoting from a retracted position to an extended position wherein the dogs wedge against the inside wall of the well casing;

a cage with a plurality of axially disposed cage fins, said cage slidably mounted on the cylindrical section of said mandrel;

a second plurality of dogs pivotally attached individually to the cage fins; and means for interconnecting in a paired relationship the dogs of said first plurality to the dogs of said second plurality.

23. The apparatus of claim 22 further including:

a cone-shaped turret attached to and actuated by perforating means and in engagement with the first plurality of dogs attached to the fins of said mandrel; and actuating means for driving said cone-shaped turret against said first plurality of dogs for pivoting to the extended position.

24. Apparatus as set forth in claim 23 wherein the means for interconnecting the first plurality of dogs to the second plurality of dogs pivots the second plurality to the extended position by operation of said cone-shaped turret.

25. Apparatus as set forth in claim 22 including means for holding said first plurality of dogs in the retracted position.

26. Apparatus as set forth in claim 25 including means for biasing said cage away from said first plurality of dogs; and said means for interconnecting the first plurality of dogs with a second plurality of dogs holds said second plurality of dogs into the retracted position with the cage biased away from said first plurality of dogs.

27. Apparatus as set forth in claim 46 including a cage latch for holding said cage into a position to engage said first plurality of dogs by movement of the cylindrical section relative to said cage.

28. A method for securing a perforator means for perforating a well casing at a predetermined stratum in a well, comprising the steps of:

attaching a hold-down means having releasable well casing engaging means to the perforator means;

running production tubing with the perforator means releasably attached thereto along with the hold-down means in the well to a position above the predetermined stratum;

running an electrical cable into the well for attachment to the perforator means;

releasing the perforator means from the production tubing;

lowering the perforator means opposite the stratum by means of the electrical cable; and detonating the perforator means to perforate the well casing and actuate said hold-down means to be wedged in the well casing.

29. Apparatus for holding a perforator means in a well casing comprising:

a tapered mandrel with a plurality of fins disposed thereon;

a plurality of dogs pivotally attached individually to one of said fins, said dogs pivoting from a retracted position to an extended position to be wedged against the inside wall of the well casing;

an inner cage attached to said mandrel; and a housing attaching to said mandrel by said inner cage and having a plurality of longitudinal splines engaging a groove in said inner cage, said housing moving from a first position wherein said dogs freely pivot to a second position secured by said splines wherein said housing shields the dogs from engaging the well casing.

30. The apparatus in claim 29 wherein said dogs have serrated edges for engaging the well casing.

* * * * *

UNITED STATES PATENT AND TRADEMARK OFFICE

CERTIFICATE OF CORRECTION

PATENT NO. : 4,375,834

DATED : March 8, 1983

INVENTOR(S) : Donald E. Trott

It is certified that error appears in the above-identified patent and that said Letters Patent is hereby corrected as shown below:

Column 11, line 29, change "perforting" to --perforating--.

Column 14, line 14, change "in claim 46" to --in claim 24--.

Signed and Sealed this

*Twenty-ninth* Day of *November 1983*

[SEAL]

*Attest:*

GERALD J. MOSSINGHOFF

*Attesting Officer*

*Commissioner of Patents and Trademarks*